US009433272B2

(12) United States Patent
Moll

(10) Patent No.: US 9,433,272 B2
(45) Date of Patent: Sep. 6, 2016

(54) HEATED HAIR CURLER WITH HINGED HAIR GRIP AND APPLICATOR HANDLE

(71) Applicant: Dawn Moll, Breinigsville, PA (US)

(72) Inventor: Dawn Moll, Breinigsville, PA (US)

( * ) Notice: Subject to any disclaimer, the term of this patent is extended or adjusted under 35 U.S.C. 154(b) by 13 days.

(21) Appl. No.: 14/206,172

(22) Filed: Mar. 12, 2014

(65) Prior Publication Data

US 2014/0261526 A1 Sep. 18, 2014

Related U.S. Application Data

(60) Provisional application No. 61/788,928, filed on Mar. 15, 2013.

(51) Int. Cl.

| | |
|---|---|
| ***A45D 2/12*** | (2006.01) |
| ***A45D 6/04*** | (2006.01) |
| ***A45D 2/36*** | (2006.01) |
| ***A45D 2/24*** | (2006.01) |
| ***A45D 4/06*** | (2006.01) |

(52) U.S. Cl.

CPC ..... *A45D 2/12* (2013.01); *A45D 2/2414* (2013.01); *A45D 2/2464* (2013.01); *A45D 2/362* (2013.01); *A45D 4/06* (2013.01); *A45D 6/04* (2013.01)

(58) Field of Classification Search

CPC ..... A45D 1/00; A45D 1/04; A45D 1/16; A45D 2001/002; A45D 2/00; A45D 2/12; A45D 2/362; A45D 2/02; A45D 2200/25; A45D 2/122; A45D 2/2414; A45D 2/36; A45D 6/04; A45D 6/02; A46B 5/0095; A46B 2200/104; A01K 13/00; A01K 13/002

USPC ..... 132/223, 226, 227, 229, 231, 232, 234, 132/269; 219/222, 225, 226

See application file for complete search history.

(56) References Cited

U.S. PATENT DOCUMENTS

| | | | | |
|---|---|---|---|---|
| 2,102,286 | A | | 12/1937 | Schmitt |
| 2,249,315 | A | | 7/1941 | Laskaris |
| 2,387,822 | A | | 10/1945 | Basky |
| 2,530,197 | A | | 11/1950 | Hall et al. |
| 2,611,378 | A | | 9/1952 | King et al. |
| 2,910,989 | A | | 11/1959 | Russell |
| 3,173,429 | A | | 3/1965 | Pauldine |
| 3,413,984 | A | * | 12/1968 | Tracy et al. ..... 132/238 |
| 3,500,837 | A | | 3/1970 | Ferens |
| 3,605,763 | A | | 9/1971 | Fusco |

(Continued)

FOREIGN PATENT DOCUMENTS

| | | | | |
|---|---|---|---|---|
| CH | 646315 A5 | * | 11/1984 | ..... A45D 6/04 |
| DE | 9416340 | * | 12/1994 | ..... A45D 20/52 |

*Primary Examiner* — Tatiana Nobrega

(74) *Attorney, Agent, or Firm* — James Ray and Assocs; Alexander Pokot

(57) ABSTRACT

A system comprises implements, each including a body, a receptacle disposed on one end of the body and having a bore and an aperture formed through spaced apart wall portions of the receptacle, a clip pivotally attached to the elongated body, and a spring operable to bias the clip for a contact with the elongated body. An applicator handle includes a body having a hollow interior and an end thereof sized and shaped to fit the bore of the receptacle, a resilient member disposed within the hollow interior, a pair of pins upstanding on the ends of the resilient member and sized to be received within the aperture and two buttons engageable with the resilient member and mounted for a linear movement, the two buttons are manually operable to move the pins toward each other for a selective engagement or disengagement of the pins with the aperture.

12 Claims, 12 Drawing Sheets

(56) References Cited

U.S. PATENT DOCUMENTS

| | | | | | |
|---|---|---|---|---|---|
| 3,610,878 | A * | 10/1971 | Thomas et al. | 219/222 | |
| 3,645,277 | A | 2/1972 | McCarthy | | |
| 3,759,271 | A | 9/1973 | Caruso | | |
| 3,812,866 | A | 5/1974 | Morane | | |
| 3,933,161 | A | 1/1976 | Strickman et al. | | |
| 4,526,184 | A | 7/1985 | Caruso | | |
| D281,823 | S | 12/1985 | Sherman | | |
| 4,564,033 | A | 1/1986 | Kin | | |
| 4,603,706 | A | 8/1986 | Caruso | | |
| 4,739,776 | A | 4/1988 | Prijic | | |
| 4,884,583 | A | 12/1989 | Long | | |
| 5,117,090 | A * | 5/1992 | Askins | 219/222 | |
| 5,365,037 | A | 11/1994 | Chan | | |
| 5,483,980 | A | 1/1996 | Lin | | |
| 5,710,861 | A | 1/1998 | Stern | | |
| 5,740,820 | A | 4/1998 | Stern | | |
| 5,884,635 | A * | 3/1999 | O'Brien | A45D 2/362 | 132/227 |
| 5,893,375 | A | 4/1999 | Majors | | |
| 6,035,099 | A | 3/2000 | Stern | | |
| 6,138,685 | A * | 10/2000 | O'Brien | A45D 2/362 | 132/207 |
| 6,360,752 | B1 | 3/2002 | Chang | | |
| D457,683 | S | 5/2002 | Spagnolo | | |
| 6,502,585 | B1 * | 1/2003 | Mazzei | A46B 7/04 | 132/237 |
| D577,152 | S | 9/2008 | Ceva | | |
| D618,394 | S | 6/2010 | Keong | | |
| D659,284 | S | 5/2012 | Amkie | | |
| D677,430 | S | 3/2013 | Kennedy et al. | | |
| 8,490,633 | B1 * | 7/2013 | Kennedy et al. | 132/228 | |
| 2005/0000954 | A1 * | 1/2005 | Schmitz | 219/222 | |
| 2005/0022836 | A1 * | 2/2005 | Tong | 132/224 | |
| 2007/0169787 | A1 * | 7/2007 | Kim | A45D 20/525 | 132/241 |
| 2008/0105274 | A1 * | 5/2008 | Kennedy | 132/210 | |
| 2008/0173322 | A1 | 7/2008 | Leung | | |
| 2008/0210255 | A1 * | 9/2008 | Moll | A45D 2/2414 | 132/223 |
| 2011/0100391 | A1 * | 5/2011 | Paolacci | A45D 1/04 | 132/226 |
| 2011/0114110 | A1 * | 5/2011 | Guthans | A45D 2/00 | 132/211 |
| 2011/0226278 | A1 * | 9/2011 | Rivola | A45D 2/001 | 132/232 |
| 2012/0152272 | A1 * | 6/2012 | Solovey | A45D 2/002 | 132/242 |

* cited by examiner

HEATED HAIR CURLER WITH HINGED HAIR GRIP AND APPLICATOR HANDLE

CROSS-REFERENCE TO RELATED APPLICATIONS

This application is related to and claims priority from U.S. Provisional Patent Application Ser. No. 61/788,928 filed on Mar. 15, 2013. This application is related to U.S. Utility patent application Ser. No. 12/004,793 filed by Applicant on Dec. 21, 2007 and published as U.S. 2008-0210255 A1 on Sep. 4, 2008. Teaching of U.S. Utility patent application Ser. No. 12/004,793 is incorporated into this document by reference thereto. This application is also related to a U.S. Design patent application Ser. No. 29/449,616, entitled "Hair Styling Curler" and filed by the inventor of this invention on Mar. 15, 2013.

FIELD OF THE INVENTION

The present invention relates, in general, to hair styling devices and, more particularly, this invention relates to hair styling curlers, curler applicator handles and curler cradles configured to heat curlers positioned therewithin.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

As is generally well known, hair curlers, either heated or unheated have been used extensively in styling one's hair with the use of applicator handle. However, it has been found that there is a need for an improved hair styling curler and applicator handle combination, particularly in the area of grasping and releasing the hair styling curler with the applicator handle.

SUMMARY OF THE INVENTION

The invention provides hair curling implements, applicator handle and a heating apparatus that define a system for styling hair of the user with heat provided by heated implements. In operation, the hair curling implements are seated onto the elongated members protruding from the apparatus and are heated for transferring the heat onto the hair of the user.

In one embodiment, the invention provides a hair styling system. The hair styling system comprises one or more hair styling implements. Each implement includes an elongated body, a receptacle disposed on one end of the body and having a bore with an out-of-round cross-section in a plane transverse to a length of the elongated body and an aperture formed through spaced apart wall portions of the receptacle. A clip is pivotally attached to one of the elongated body and the receptacle. A spring is mounted in an abutting contact with an inner surface of the clip and operable to bias the clip for a contact with the elongated body. There is also an applicator handle that includes a body having a hollow interior and an end thereof sized and shaped to fit the bore of the receptacle. A U-shaped resilient member is disposed within the hollow interior. A pair of pins upstand on the ends of the U-shaped resilient member and are sized to be received within the aperture when the end of the body of the handle is inserted into the bore. There is also a pair of button-shaped members engageable with the U-shaped resilient member and mounted for a linear movement in a direction transverse to a length of the body of the applicator handle. The pair of button-shaped members are manually operable to move the pins toward each other for a selective engagement or disengagement with the apertures and selective engagement of the end with the bore or a removal therefrom.

OBJECTS OF THE INVENTION

It is, therefore, one of the primary objects of the present invention to provide a hair styling curler having a hinged grip portion.

Another object of the present invention is to provide a hair styling curler configured to receive and retain heat.

Yet another object of the present invention is to provide a hair styling curler configured to transfer heat to a strand of hair curled on a body thereof.

Still another object of the present invention is to provide a hair styling curler having a connection with an applicator handle.

A further object of the present invention is to provide an applicator handle configured to grasp heated hair styling curler and release such hair styling curler at a point of use.

Yet a further object of the present invention is to provide an applicator handle that is easy and convenient to use.

An additional object of the present invention is to provide an applicator handle that includes a resilient gripping member.

Another object of the present invention is to provide an apparatus having one or more heating elements disposed within a hollow interior of a housing and configured to transfer heat to vertically disposed elongated members partially extending past the exterior surface of the housing.

A further object of the present invention is to provide an apparatus adapted to at least temporarily retain an applicator handle for hair styling curler on the exterior surface of the housing.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
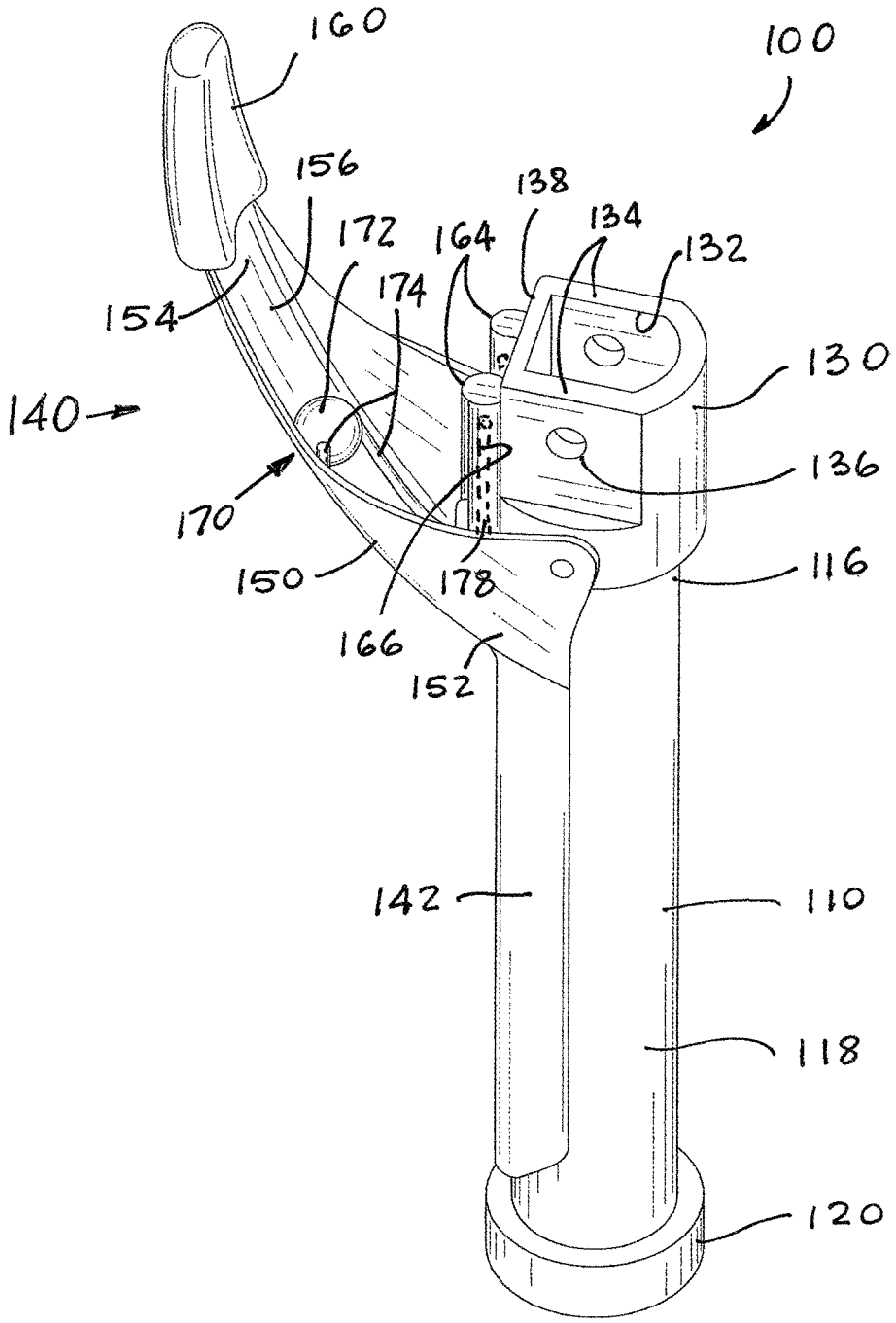
FIG. 1 is a perspective view of a hair styling curler.
Figure 2:
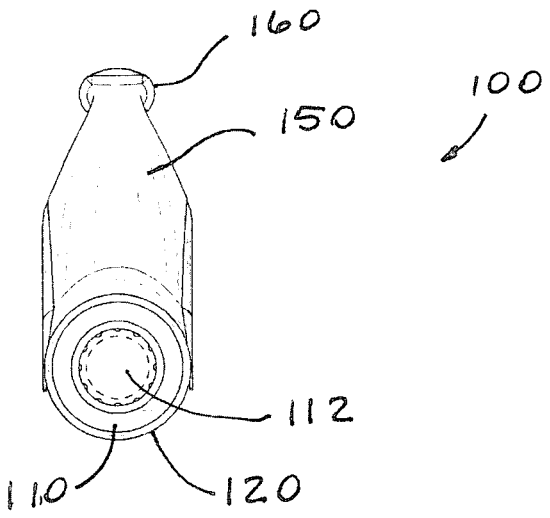
FIG. 2 is a left end elevation view thereof.
Figure 3:
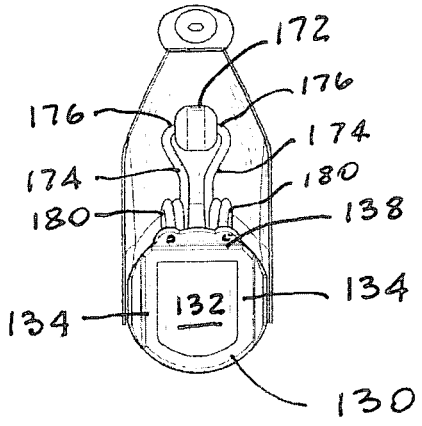
FIG. 3 is a right end elevation view thereof.
Figure 4:
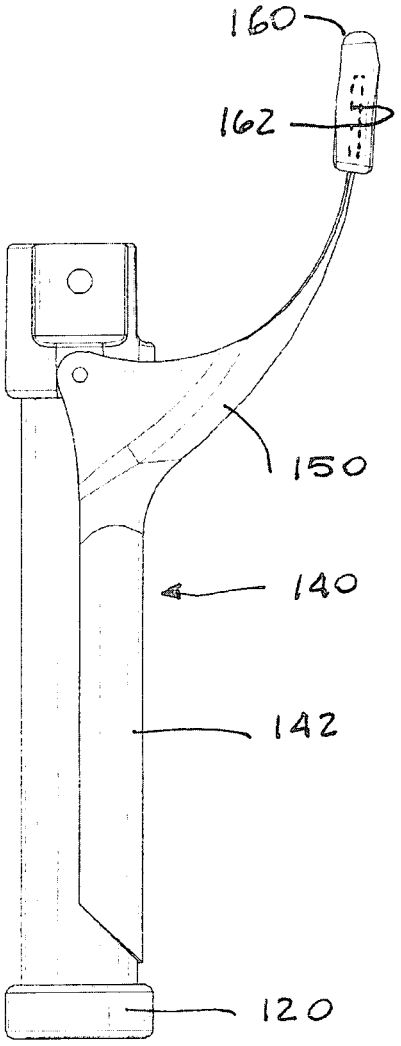
FIG. 4 rear side elevation view thereof.
Figure 5:
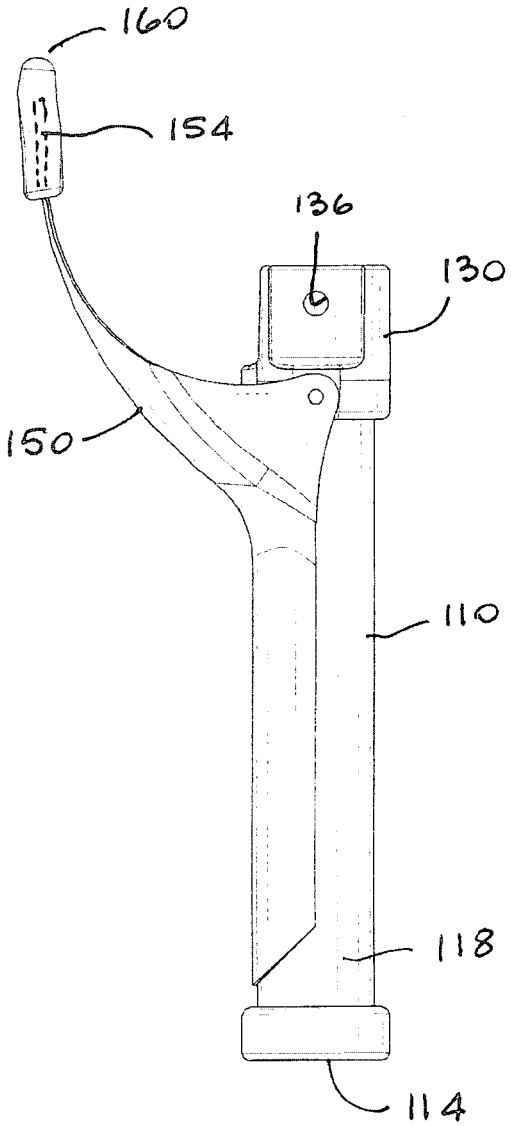
FIG. 5 front side elevation view thereof.
Figure 6:
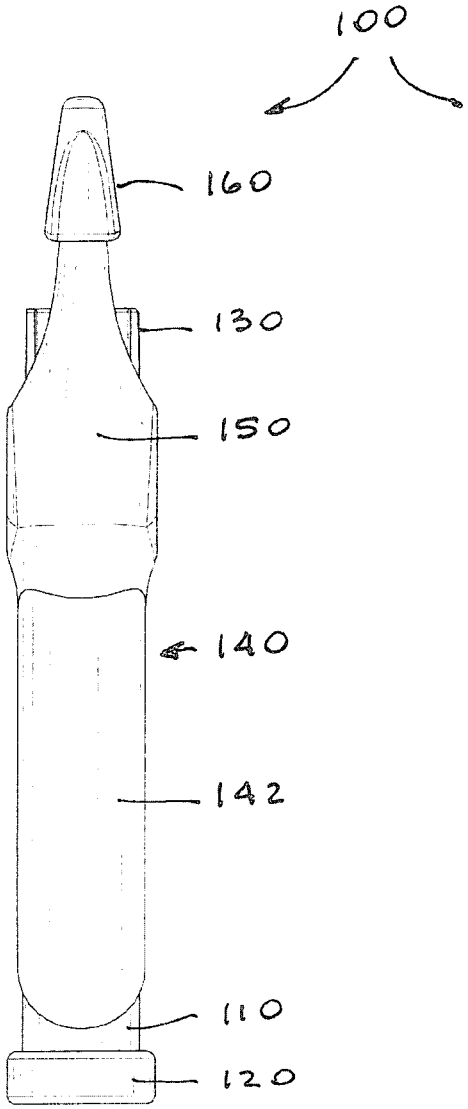
FIG. 6 top planar view thereof.
Figure 7:
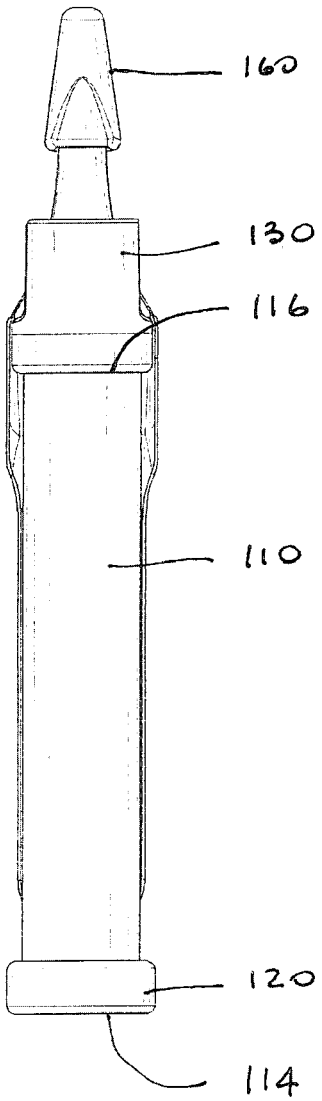
FIG. 7 bottom planar view thereof.
Figure 8:
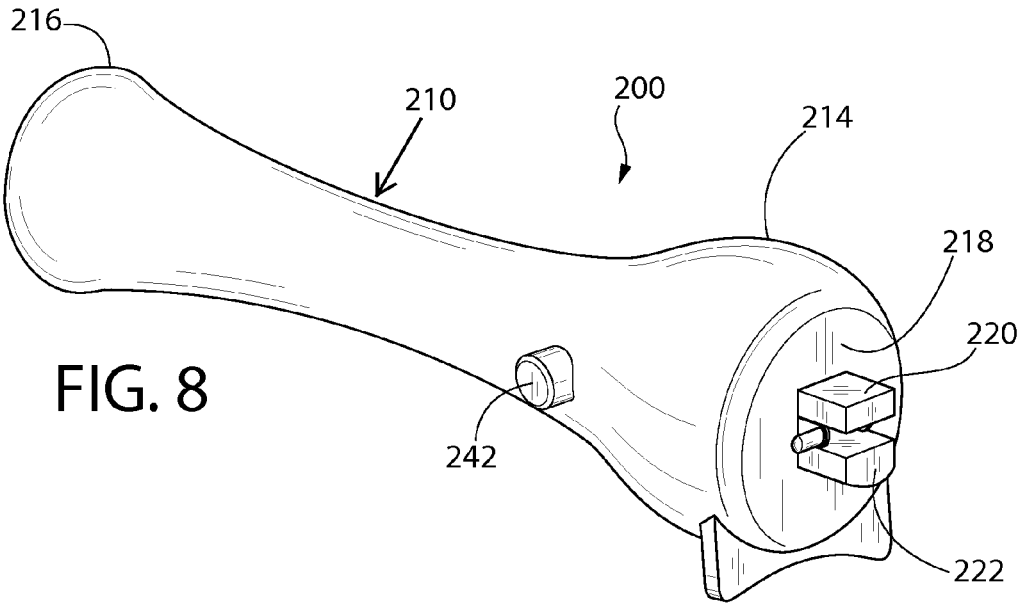
FIG. 8 is a perspective view of an applicator handle for use with hair styling curlers of FIGS. 1-7.
Figure 9:
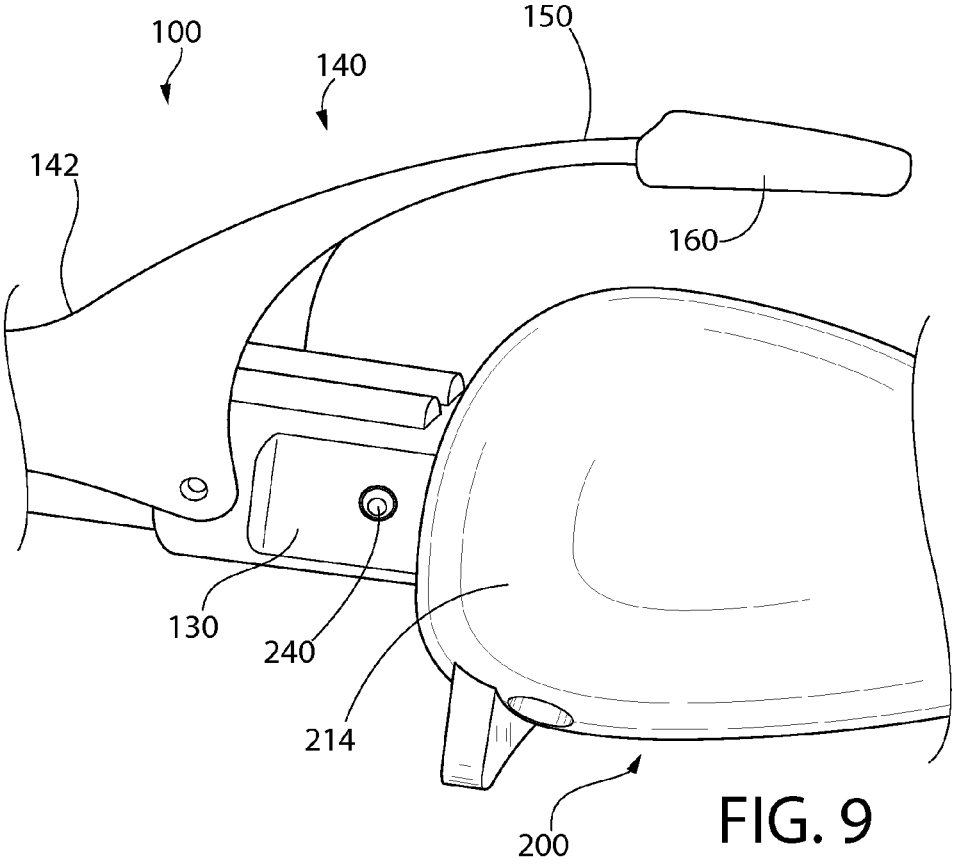
FIG. 9 is a partial perspective view of the applicator handle of FIG. 8, particularly illustrating engagement with the hair styling curlers of FIGS. 1-7.

Prior to proceeding to the more detailed description of the present invention, it should be noted that, for the sake of clarity and understanding, identical components which have identical functions have been identified with identical reference numerals throughout the several views illustrated in the drawing figures.

The instant invention provides a hair styling system that comprises one or more hair styling curlers or implements, generally designated as 100, and an applicator handle, generally designated as 200.

Reference is now made, to FIGS. 1-7, wherein there is shown a hair styling curler or implement 100 configured to transfer heat to a strand of hair curled on a surface thereof. Moreover, the implement 100 includes an elongated body 110 having a hollow interior 112 and a ring shaped cross-section in a plane transverse to a length of the elongated body 110. Such ring shape cross-section defines a wall thickness of the elongated body 110. An annular abutment 120 is disposed on an exterior surface 118 of the elongated body 110 generally at one end 114 thereof.

The elongated body 110, in one form, is manufactured from plastic, ceramic or composite materials. The elongated body 110, in another form, is manufactured from a metal. The annular abutment 120 is preferably manufactured from plastic, ceramic or composite materials.

There is also a receptacle 130 disposed on an axially opposite end 116 of the elongated body 110 in axial alignment therewith. The receptacle 130 has a bore 132 with an out-of round cross-section in the plane transverse to the length of the elongated body 110. In a presently preferred embodiment, the receptacle 130 is illustrated as having a pair of wall portions 134 disposed in a parallel relationship with each other. Wall portions 134 are formed by the bore 132. An aperture 136 is formed through a thickness of each wall portion 134.

The receptacle 130 is preferably manufactured from plastic, ceramic or composite materials.

A unitary clip or grip 140 has an elongated first portion 142 with an arcuate cross-section in the plane transverse to the length of the elongated body 110. The first portion 142 is movable between a first position being disposed in a direct contact with the exterior surface 112 of the elongated body 110 or spaced apart therefrom by hair strands and a second position being inclined at an angle relative to the length of the elongated body 110. The unitary clip 140 further includes a second portion 150 having an arcuate cross-section in the plane transverse to the length of the elongated body 110 and in a plane parallel to the length of the elongated body 110. The second portion 150 narrowing from a proximal end 152 thereof to a distal end 154 being spaced apart from the receptacle 130 and the elongated body 110. The unitary clip 140 is pivotally attached, generally mediate first and second portions thereof, to either elongated body 110 or receptacle 130 generally adjacent the axially opposite end 116 of the elongated body 110. The unitary clip 140 is preferably manufactured from metal.

An optional soft and resilient grip member 160 may be affixed to the distal end 154 of the second portion 150 by way of a cavity 162 sized to receive such distal end 154 therewithin either in a frictional manner, by way of adhesive (not shown) or being molded thereonto.

There is also a pair of elongated abutments 164 disposed in a spaced apart relationship with each other on an exterior surface 138 of the receptacle 130 in a general alignment with the first portion 132 of the unitary clip 130. Each of the pair of elongated abutments 164 having a spring aperture 166 formed axially along a partial length thereof and can extend through entire length.

Finally, a spring 170 is positioned and configured to bias the first portion 142 into the first position. The spring 170 includes a generally spherical member 172 positioned to abut an inner surface 156 of the second portion 150, a pair of legs 174 having proximal ends 176 thereof extending from diametrically opposite points on the generally spherical member 172 and having distal ends 178 thereof received within spring apertures 166 of the respective elongated abutments 164, and one or more coil portions 180 defined between the proximal and distal end, 176 and 178 respectively of each leg 174.

In operation, the hair strands of the user are curled (wrapped or coiled) around the exterior surface 118 of the elongated body 110 and are held/gripped in place by the first portion 142 of the clip 140 while the heat from the body 110 is being transferred to such curled hair strands. The user manually operates the clip 140 in order to curl or release the curled hair strands by a pivoting motion enacted by the second portion 150.

Reference is now made, to FIGS. 8-12 and 16-18, wherein there is shown the applicator handle 200. The handle 200 includes an elongated body 210 having a generally closed hollow interior 212. The elongated body 210 has a cross-section at a midpoint thereof being smaller than cross-section at each end 214, 216 of the elongated body 210. Furthermore, the elongated body 210 may be provided by a pair of sections or halves joined together by any conventional techniques, such as fastening, molding, adhesives and the like.

A pair of members 220 and 222 are disposed in a spaced apart relationship with each other on an exterior surface 218 of one end of the elongated body 210, shown as proximal end 214. The pair of members 220, 222 are sized and configured to fit within the bore 132 of the receptacle 130. The invention also contemplates that the pair of members 220, 222 may be configured to a define a unitary construction An aperture 224 is formed through a thickness of the proximal end 214 and being generally disposed between the pair of members 220, 222.

A resilient gripping member 230 is provided and has a generally U-shaped first portion 232 thereof mounted within the hollow interior 212 and having a pair of second portions 236 partially extending from the first portion 232 through the aperture 224 in the proximal end 214 of the elongated body 210 past the exterior surface 218 thereof.

There is a pair of pins 240, each extending outwardly from a respective second portion 236 generally perpendicular to the length of the handle 200. The pair of pins 240 are being disposed between the pair of members 220, 222. Pins 240 are sized and shaped to be received within the apertures 136 of the receptacle 130. The pair of members 220, 222 may be also provided as defining a unitary end of the applicator handle 200, for example when the body 210 is manufactured from a pair of halves.

A pair of buttons or button-shaped members 242 may be also provided with each of the pair of buttons 242 having an interior end 244 thereof abutting an exterior surface of the first portion 232 and having a portion 246 thereof extending past an exterior surface of the elongated body 210.

In operation, depression of button shaped members 242, upon a manual force applied thereto, causes the second portions or ends 236 to collapse toward each other and further causes the pins 240 to move toward each other, thus enabling a withdrawal of the pins 240 from engagement with apertures 136, and further allows the members 220, 222 to be withdrawn from the bore 132 of the receptacle 130. In a similar manner, depression of buttons 242 causes the second portions 236 to collapse toward each other thus allowing insertion of the members 220, 222 into the bore 132. Subsequent removal of the manual force and subsequent release of the button shaped members 242 causes the first portion 232 to spring back, due to the resiliency of the resilient gripping member 230, and further causes the pins 240 to engage the apertures 136, thus at least temporarily securing the implement 100 on the applicator handle 200.

Thus, the resilient gripping member 230 with the button shaped members 242 essentially provide a manually operable means for selectively engaging the end of the applicator handle 200 with the receptacle 130 of the hair styling curler 100 or disengaging the end of the applicator handle 200 therefrom.

Applicator handle 200 can be rested on a foot or support 248 with or without the implement 100.

Figure 10:
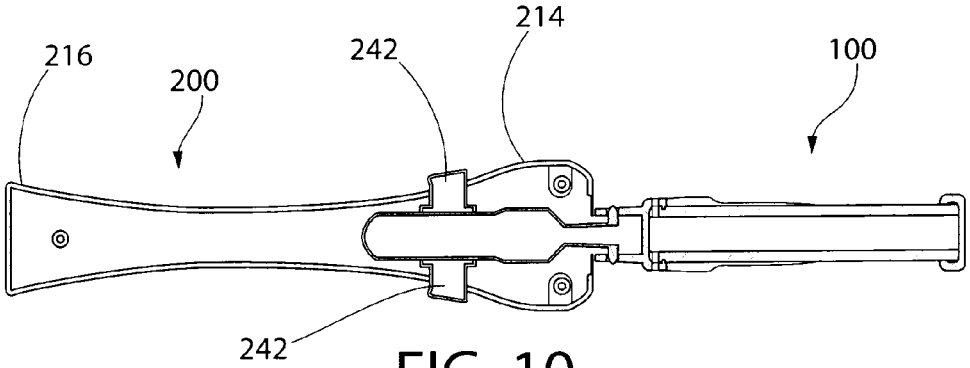
FIG. 10 is a cross-sectional view of the applicator handle of FIG. 8 and the hair styling curler of FIG. 1.
Figure 11:
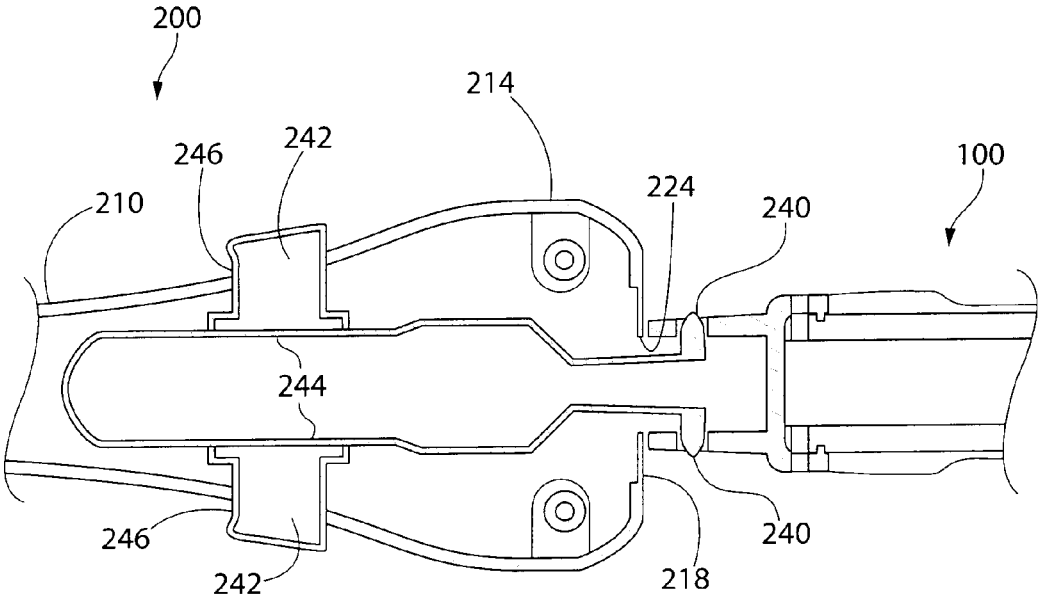
FIG. 11 is a partial enlarged view of the applicator handle and the hair styling curler of FIG. 10.
Figure 12:
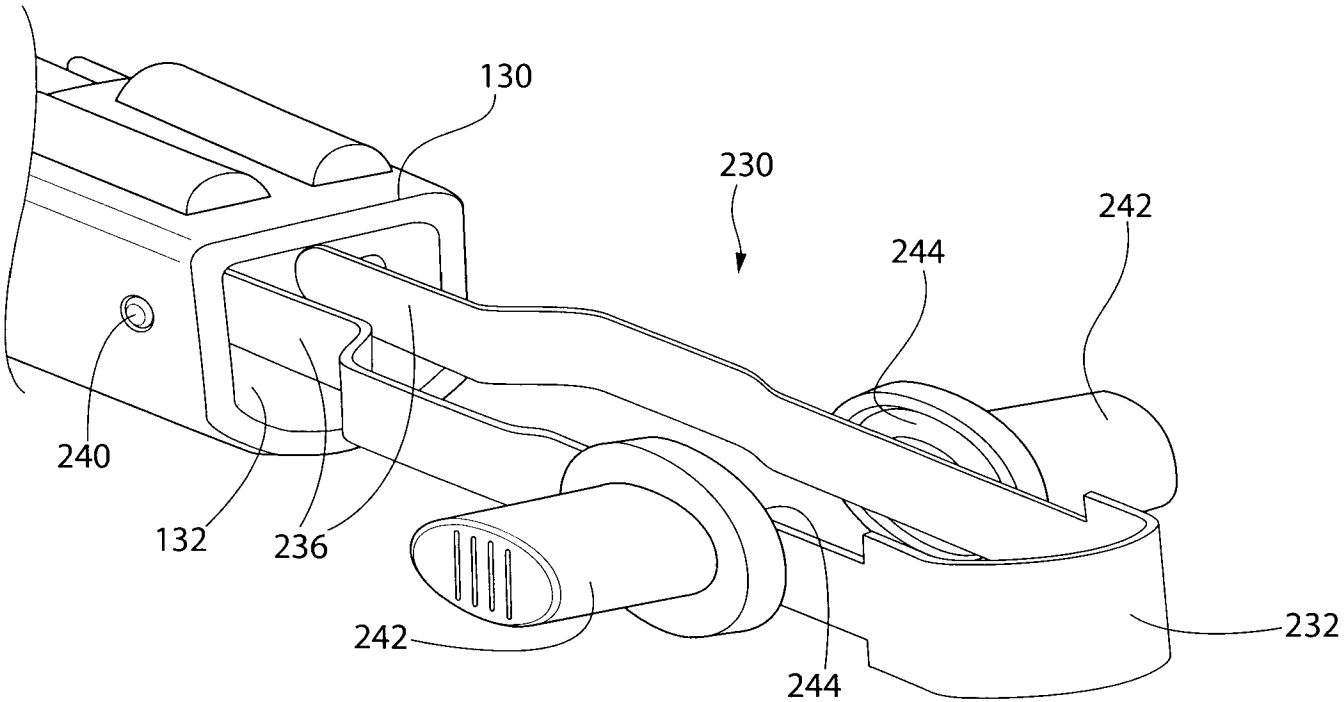
FIG. 12 is a perspective view of the applicator handle of FIG. 8, particularly illustrating a curler gripping member.

The presently preferred appearance of the applicator handle 200 defines a peripherally concave transition between the proximal and distal ends 214 and 216 respectively and further defines a generally bulbous proximal end 214 with a generally planar surface 218. The distal end 216 defines a generally planar surface 217, as best shown in FIG. 10.

Figure 13:
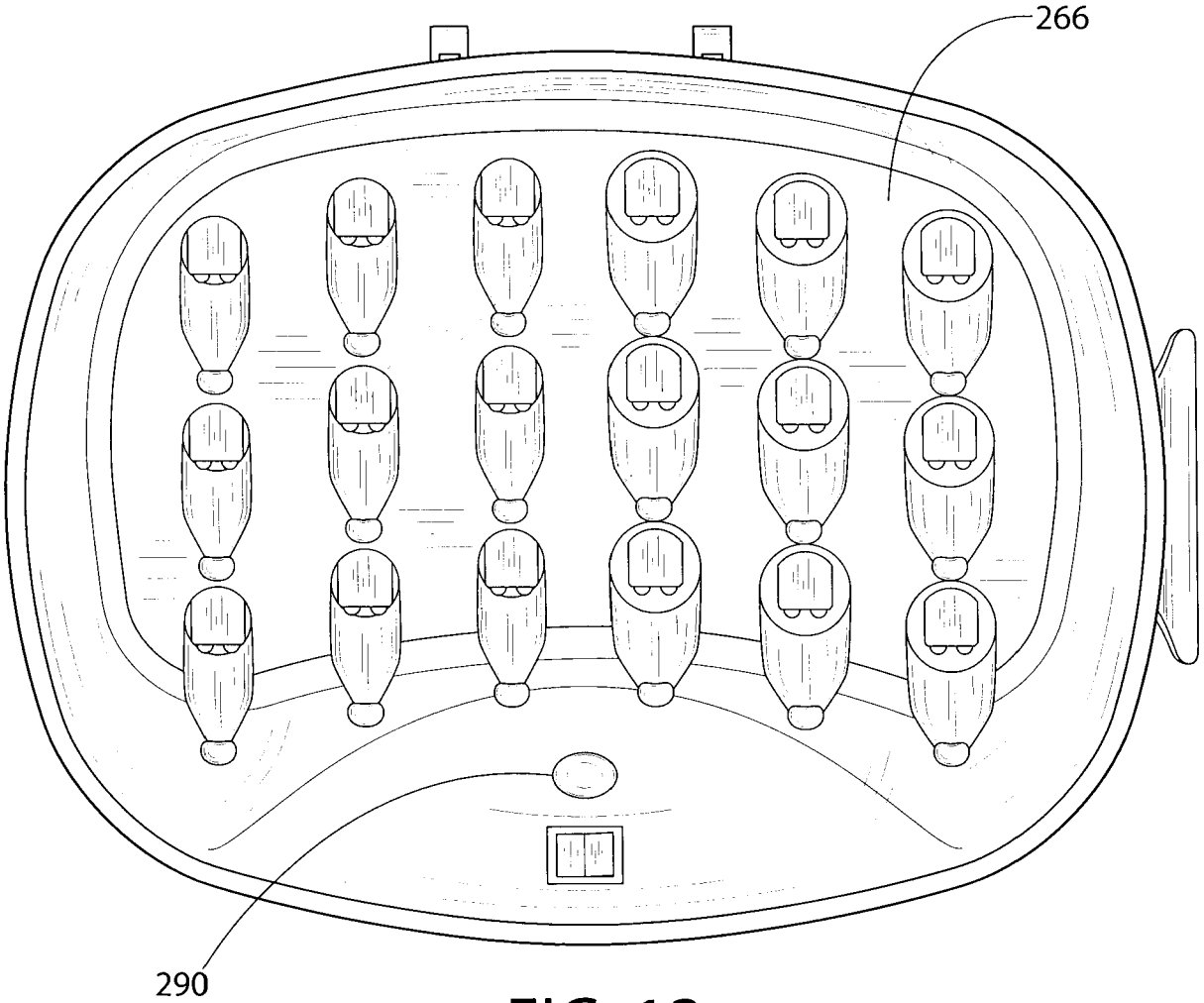
FIG. 13 is a top planar view of an apparatus for heating hair styling curlers of FIGS. 1-7.
Figure 14:
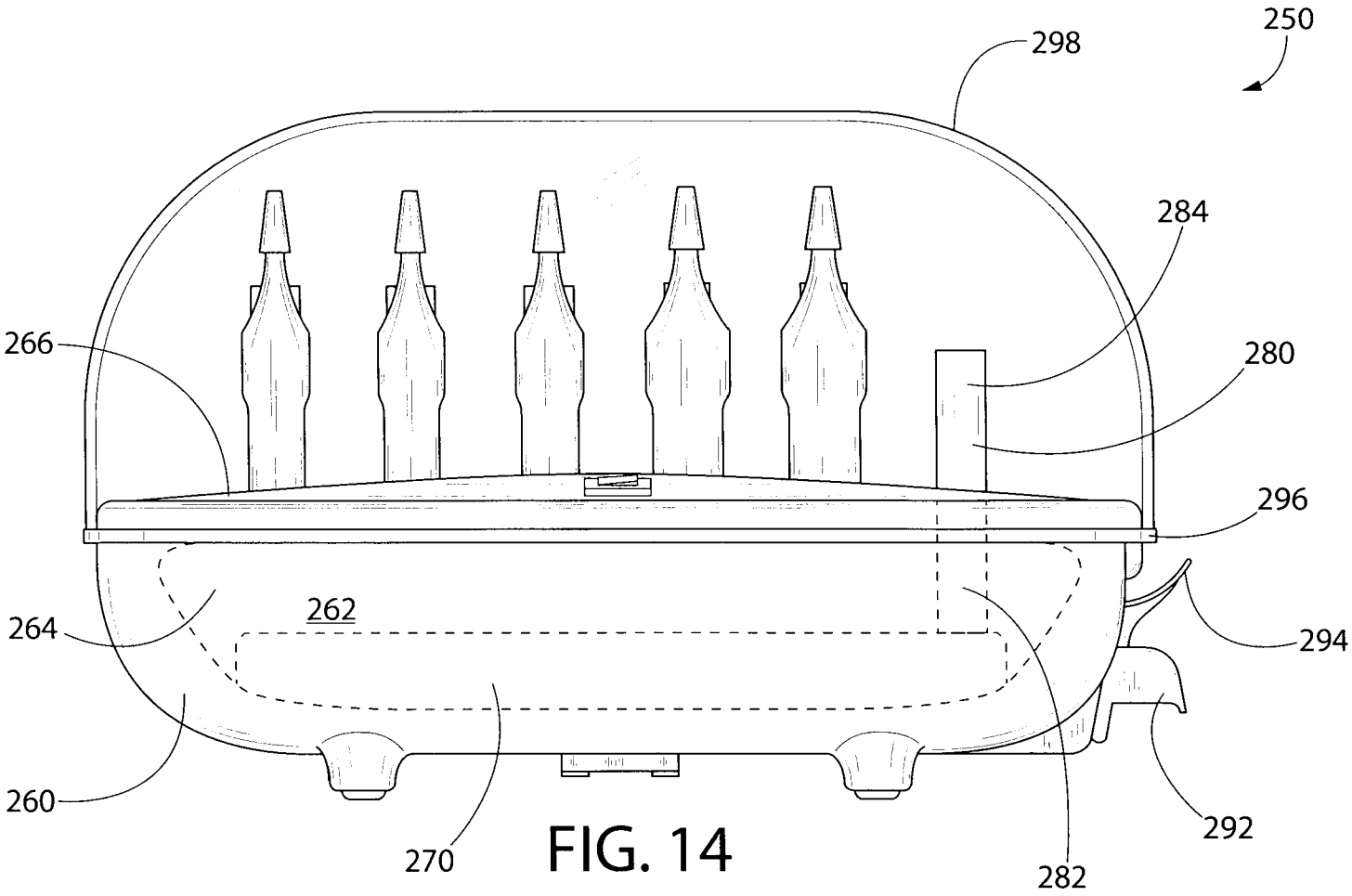
FIG. 14 is a front elevation view of the apparatus of FIG. 13.
Figure 15:
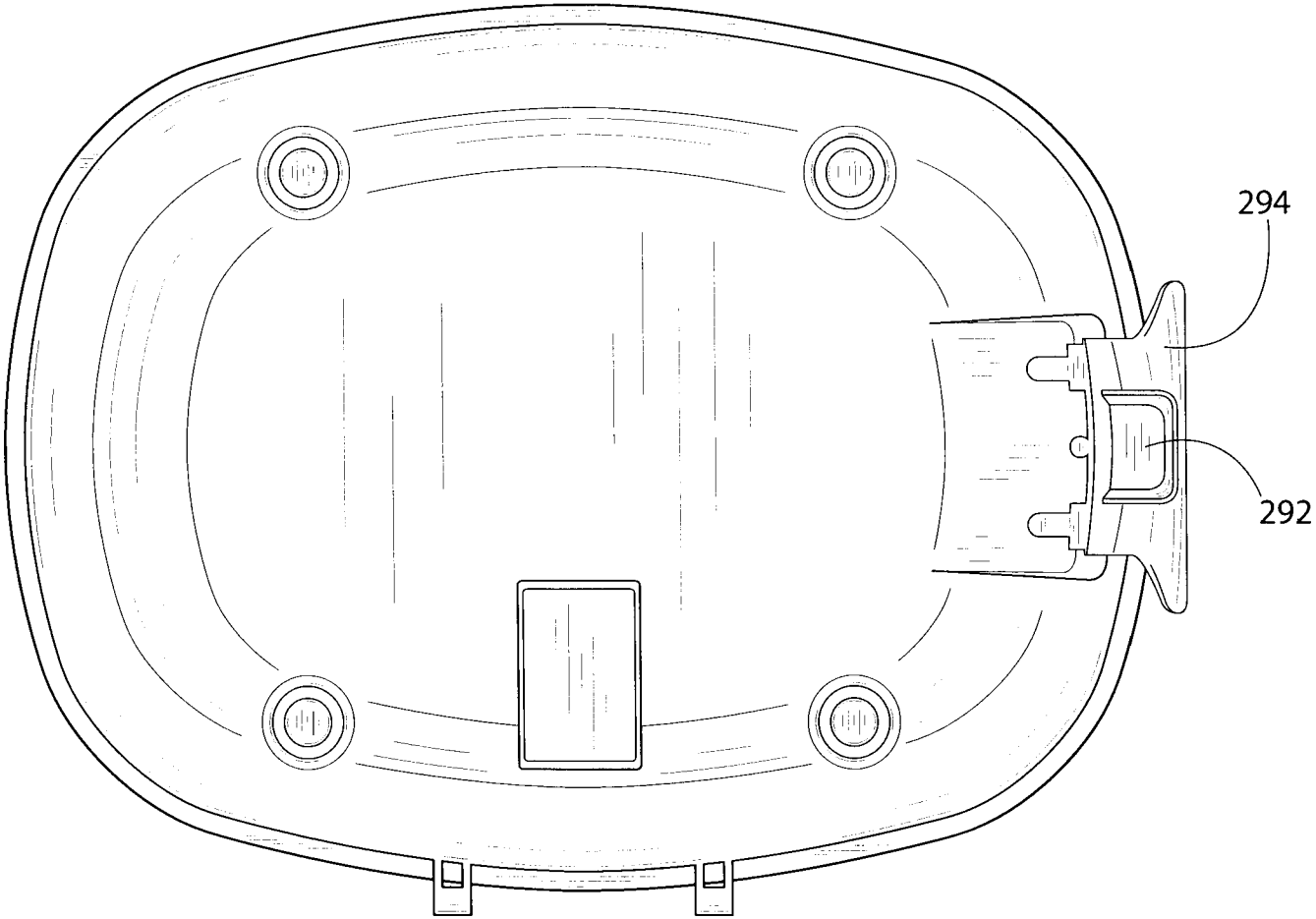
FIG. 15 is a bottom planar view of the apparatus of FIG. 13.
Figure 18:
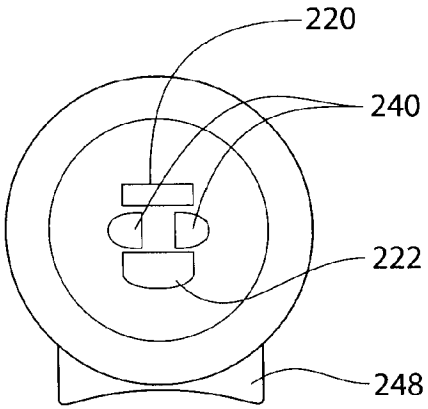
FIG. 18 illustrates elevation view of a proximal end of the applicator handle of FIG. 8.
Figure 16:
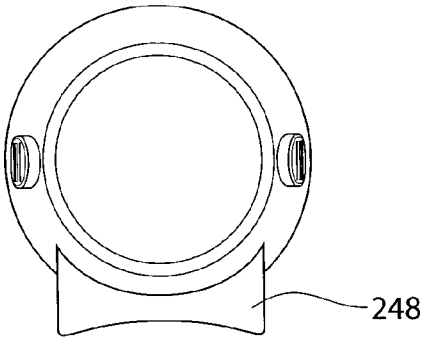
FIG. 16 illustrates elevation view of a distal end of the applicator handle of FIG. 8.
Figure 17:
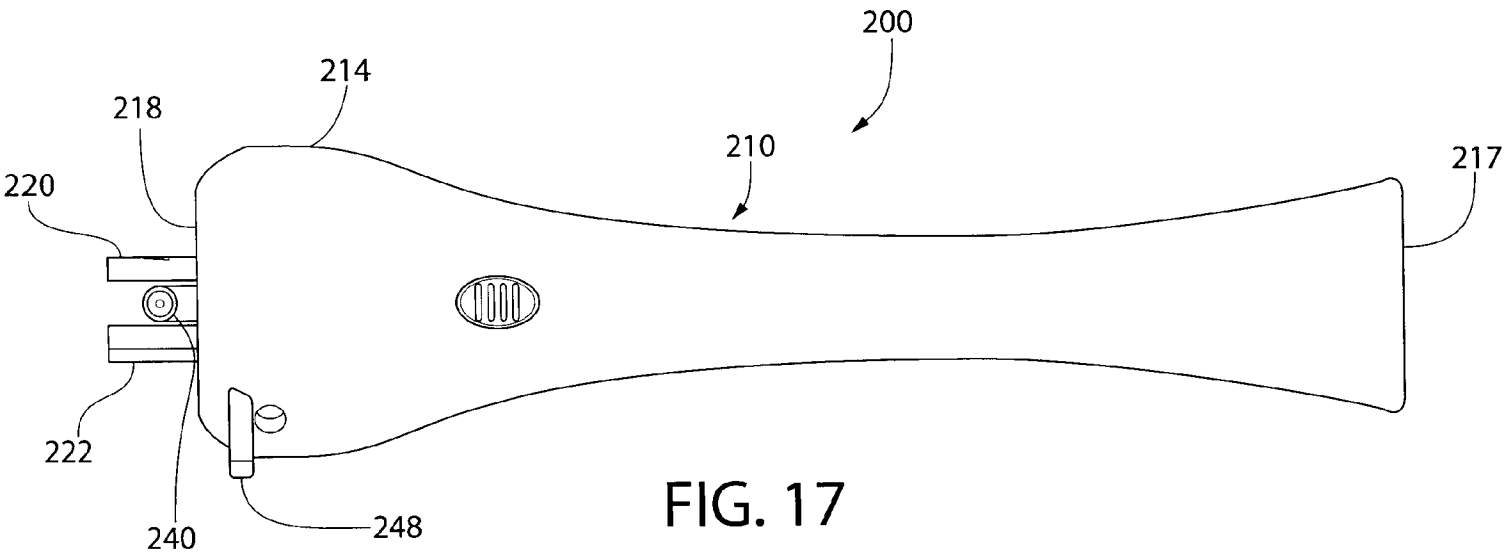
FIG. 17 illustrates a rear elevation view of the applicator handle of FIG. 8.

Now in reference to FIGS. 13-15, therein is illustrated an optional apparatus, generally designated as 250 for heating the hair styling implements 100. The apparatus 250 includes a housing 260 having a generally closed hollow interior 262 and exterior surfaces 264 and 266.

One or more heating elements 270, for example such as conventional heating coils are disposed within the hollow interior 262 and operatively coupled to a source of electrical power. The one or more heating elements 270 are configured to generate heat energy upon supply of electrical power thereto.

Elongated members 280 are provided and have a first portion 282 thereof disposed within the hollow interior 262 in an operative coupling with the one or more heating elements 270 and having a second portion 284 thereof extending past the surface 266 of the housing 260, generally perpendicular thereto.

A switch 290 is manually operable from the exterior surface 264 or 266 of the housing 260 to selectively supply and discontinue supply of the electrical power to the elongated members 280, whereby the elongated members 280 radiate heat external to the housing 260 when the switch 290 is operable to supply the electrical power to one or more heating elements 270. Thus, each elongated member 280 functions as a heat transfer element to transfer heat energy from the one or more heating elements 270 to the body 110 of the hair styling curler 100.

A handle 292 is disposed on the exterior surface 266 of the housing 260. A cradle, defined by a first member 294 and a second member or tab 296, is disposed on the exterior surface 266 of the housing 260 and is configured to retain the applicator handle 200 therewithin.

A dome shaped cover 298 may be provided and configured to selectively cover and uncover the second portions 284 of the elongated members 280.

Implements 100, applicator handle 200 and apparatus 250 define a system for styling hair of the user with heat provided by heated implements 100.

Receptacle 130, members 220, 222 and gripping member 230 provide means for selectively gripping and releasing the implement 100 that can be also defined by the elongated body 110 and the clip 140.

Apparatus 250 provides means for heating implements 100 so that the heat can be then transferred to strands of user's hair curled on the elongated body 110 and gripped or clipped in place with the clip 140.

In operation, the implements 100 are seated onto the second portions 284 and are heated for transferring the heat onto the hair of the user. The user then uses the handle 200 to individually remove heated implements 100 and support each implement 100 during the curling effort. When the hair strand is curled about the peripheral surface 118 of the elongated body 110, the user presses the button-shaped members 242 to disengage the applicator handle 200 from the implement 100. The process continues until the user used sufficient number of implements 100. Implements 100 can be returned into the apparatus 250 and reseated onto the second portion 284 either manually or by way of the applicator handle 200.

Although the present invention has been shown in terms of the engagement between the hair styling curler 100 and the applicator handle 200 by way of movable pins 240 and apertures 136, it will be apparent to those skilled in the art, that other releasable engagements may be applied in the instant invention.

Figure 19:
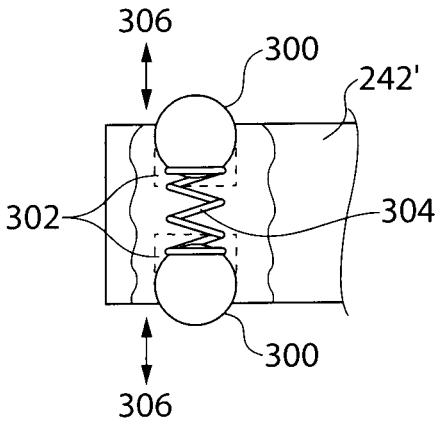
FIG. 19 illustrates one alternative form of an engagement between the hair styling curler and the applicator handle.

By way of one example of FIG. 19, the pins 240 are replaced by a pair of spherical members 300 disposed within cavities 302 in the end 242' of the applicator handle 200 and are sized to engage apertures 136. The spherical members 300 are biased by a spring 304 for a reciprocal movement in a direction 306.

Figure 20:
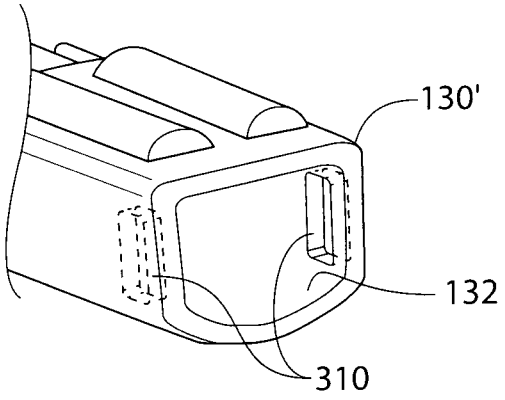
FIG. 20 illustrates another alternative form of an engagement between the hair styling curler and the applicator handle.

By way of another example of FIG. 20, the apertures 136 are replaced with grooves 310 sized to receive the pins 240 therewithin. Embodiment of FIG. 20 also allows to provide a round shape of the bore 132, with the grooves 310 even being a continuous groove.

It would be understood that the instant invention is contemplated to at least significantly reduce if not eliminate in its entirety a contact with the heated hair curling rollers 100 during removal of such heated hair curling rollers 100 from the heating elements 280 and during disengagement of the applicator handle 200 after the strand of hair has been curled around the peripheral surface 118 of the body 110.

Figure 21:
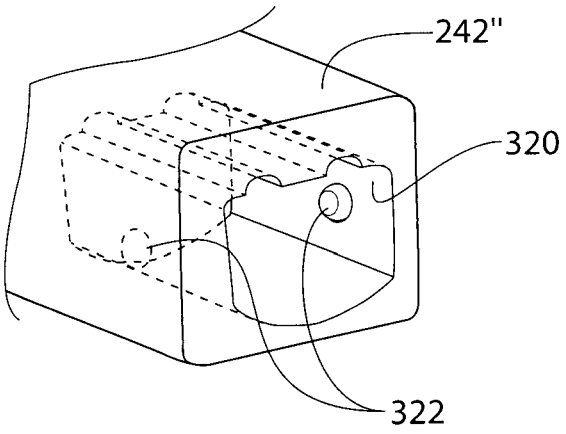
FIG. 21 illustrates a further alternative form of an engagement between the hair styling curler and the applicator handle.

However, the instant invention allows for the user to grasp the grip 140, which is generally unheated, during disengagement of the applicator handle 200 after the strand of hair has been curled around the peripheral surface 118 of the body 110, and further allows different engagement arrangements between the hair styling curler 100 and the applicator handle 200, even when the receptacle 130 is sized to be received within the end 242" of the applicator handle 200, as it is shown by way of a further example in FIG. 21, wherein the end 242" is adapted with a bore 320 having apertures 322 formed through walls of the now partially hollow end 242" and wherein the receptacle 130 may be adapted with the arrangement of FIG. 19.

Furthermore, in applications when the user is to grasp the grip 140, the ends 220, 242 may be configured to frictionally engage the bore 132 of the receptacle 130, for example in a manner when such ends 220, 242 are manufactured from a resilient material, thus eliminating the need for apertures 136 and the resilient gripping member 230 of the applicator handle 200. Or, alternatively, the receptacle 130 may be configured without the bore 130 to fit the bore 230 of FIG. 21 sufficiently to provide means for transferring the hair styling curler 100 from the apparatus 250 to a location of use.

It will be further understood that the housing 260 may be provided in different shapes and sizes to accommodate desired number of hair curling implements 100.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A hair styling system, comprising:

(a) one or more hair styling implements, each including an elongated body; a receptacle disposed on one end of said body and having a bore defining spaced-apart wall portions and having an out-of-round cross-section in a plane transverse to a length of said elongated body and apertures formed through said spaced apart wall portions of said receptacle; a clip pivotally attached to one of said elongated body and said receptacle; and a spring mounted in an abutting contact with an inner surface of said clip and operable to bias said clip to contact an exterior surface of said elongated body; and (b) an applicator handle including a body having a hollow interior and a pair of members disposed in a spaced apart relationship with each other on an exterior surface of an end of said body and being sized and shaped to fit into said bore of said receptacle; a U-shaped resilient member disposed within said hollow interior; a pair of pins upstanding on ends of said U-shaped resilient member between said pair of spaced apart members and being sized to be received within said apertures when said pair of spaced apart members are inserted into said bore; and a pair of button members engageable with said U-shaped resilient member and mounted for linear movement in a direction transverse to a length of said body of said applicator handle, said pair of button members are manually operable to move said ends of said U-shaped resilient member toward each other for a selective engagement or disengagement of said pair of pins with said apertures.

2. The hair styling system of claim 1, wherein said clip includes an elongated first portion with an arcuate cross-section in said plane transverse to said length of said elongated body and having one end thereof pivotally coupled to said receptacle, said first portion movable between a first position being disposed in contact with said exterior surface of said elongated body or spaced apart therefrom by hair strands and a second position being inclined at an angle relative to said elongated body, said clip further including a second portion having an arcuate cross-section in said plane transverse to said length of said elongated body and in a plane parallel to said length of said elongated body, said second portion narrowing from a proximal end thereof to a distal end being spaced apart from said receptacle and said elongated body.

3. The hair styling system of claim 1, wherein said elongated body having a hollow interior and a ring shaped cross-section in a plane transverse to a length of said elongated body.

4. The hair styling system of claim 1, wherein said spring includes a generally spherical member positioned to abut an inner surface of said second portion of said clip, a pair of legs having proximal ends thereof extending from diametrically opposite points on said generally spherical member and having distal ends thereof received within respective elongated abutments provided in said receptacle, and one or more coil portions defined between said proximal and distal end of each leg.

5. The hair styling system of claim 1, wherein said body of said applicator handle includes a pair of apertures formed through a wall thickness thereof and wherein each of said pair of button members is sized to fit within a respective aperture for said linear movement.

6. The hair styling system of claim 1, wherein each of said pair of pins extends outwardly from a respective end of said U-shaped resilient member and in a direction generally perpendicular to said length of said body.

7. The hair styling system of claim 1, wherein each of said pair of button members having an interior surface thereof abutting an exterior surface of said U-shaped resilient member and having an exterior portion thereof extending past an exterior surface of said body of said applicator handle.

8. The hair styling system of claim 1, further comprising an apparatus for heating said one or more hair styling implements.

9. The hair styling system of claim 8, wherein said apparatus comprises:

(a) a housing having a generally closed hollow interior;

(b) one or more heating elements disposed within said hollow interior of said housing and operatively coupled to a source of electrical power, said one or more heating elements configured to generate heat upon supply of electrical power thereto;

(c) elongated members having a first portion thereof disposed within said hollow interior in operative coupling with said one or more heating elements and having a second portion thereof extending past a surface of said housing, generally perpendicular thereto;

(d) a switch manually operable from an exterior surface of said housing to selectively supply and discontinue supply of electrical power to said elongated members, whereby said elongated members radiate heat external to said housing when said switch is operable to supply electrical power to said one or more heating elements;

(e) a handle disposed on an exterior surface of said housing; and (f) a cradle disposed on said exterior surface of said housing.

10. The hair styling system of claim 9, wherein said apparatus further comprises a dome shaped cover configured to selectively cover and uncover said second portions of said elongated members.

11. The hair styling system of claim 9, wherein said cradle includes a first member and a second member spaced apart from each other so as to releasably retain said body of said applicator handle therebetween.

12. A hair styling system comprising:

(a) one or more hair styling implements, each including:

i. an elongated body having a hollow interior and a ring shaped cross-section in a plane transverse to a length of said elongated body, ii. an annular abutment disposed on an exterior surface of said elongated body generally at one end thereof, iii. a receptacle disposed on an axially opposite end of said elongated body in axial alignment therewith, said receptacle having a bore with an out-of-round cross-section in said plane transverse to said length of said elongated body and defining a pair of parallel disposed wall members and an aperture aperture formed through a thickness of each wall member, iv. a unitary clip having an elongated first portion with an arcuate cross-section in said plane transverse to said length of said elongated body and having one end thereof pivotally coupled to said receptacle adjacent said axially opposite end of said elongated body, said first portion movable between a first position being disposed in contact with said exterior surface of said elongated body or spaced apart therefrom by hair strands and a second position being inclined at an angle relative to said elongated body, said unitary clip further including a second portion having an arcuate cross-section in said plane transverse to said length of said elongated body and in a plane parallel to said length of said elongated body, said second portion narrowing from a proximal end thereof to a distal end being spaced apart from said receptacle and said elongated body, v. a grip member affixed to said distal end of said second portion of said clip, vi. a pair of elongated abutments disposed in a spaced apart relationship with each other on an exterior surface of said receptacle in general alignment with said first portion of said clip, each of said pair of elongated abutments having a spring aperture formed along a length thereof, and vii. a spring positioned and configured to return said first portion of said unitary clip into said first position, said spring including a generally spherical member positioned to abut an inner surface of said second portion, a pair of legs having proximal ends thereof extending from diametrically opposite points on said generally spherical member and having distal ends thereof received within respective elongated abutments, and one or more coil portions defined between said proximal and distal end of each leg; and (b) an applicator handle including:

i. a body having a generally closed hollow interior, said body having a cross-section at a midpoint thereof being smaller than a cross section at each end of said body, ii. a pair of members disposed in a spaced apart relationship with each other on an exterior surface of one end of said body;

iii. an aperture formed through a thickness of said one end and being generally disposed between said pair of members, iv. a resilient member having a generally U-shaped first portion thereof mounted within said hollow interior and having a pair of second portions partially extending from said first portion through said aperture in said one end of said body past the exterior surface thereof, v. a pair of pins, each of said pins extending outwardly from a respective second portion of said resilient member in a direction generally perpendicular to said length of said body, each of said pair of pins sized and positioned to selectively engage or disengage a respective one of said apertures formed through said thickness of said parallel wall members of said receptacle, and vi. a pair of buttons, each of said buttons having an interior surface thereof abutting an exterior surface of said first portion of said resilient member and having an exterior portion thereof extending past an exterior surface of said body.

* * * * *